US010537752B2

(12) United States Patent
Cooper

(10) Patent No.: US 10,537,752 B2
(45) Date of Patent: Jan. 21, 2020

(54) HARNESS ASSEMBLY FOR AIRCRAFT PILOT CREW MASK

(71) Applicant: B/E Aerospace, Inc., Wellington, FL (US)

(72) Inventor: Alice R. Cooper, Kansas City, MO (US)

(73) Assignee: B/E Aerospace, Inc., Winston-Salem, NC (US)

( * ) Notice: Subject to any disclaimer, the term of this patent is extended or adjusted under 35 U.S.C. 154(b) by 892 days.

(21) Appl. No.: 14/754,460

(22) Filed: Jun. 29, 2015

(65) Prior Publication Data

US 2016/0375275 A1 Dec. 29, 2016

(51) Int. Cl.

| | |
|---|---|
| ***A62B 7/14*** | (2006.01) |
| ***A62B 18/02*** | (2006.01) |
| ***A62B 18/08*** | (2006.01) |
| ***A62B 9/04*** | (2006.01) |

(52) U.S. Cl.
CPC ..... *A62B 7/14* (2013.01); *A62B 9/04* (2013.01); *A62B 18/02* (2013.01); *A62B 18/084* (2013.01)

(58) Field of Classification Search
CPC ..... A61M 16/083; A62B 7/14; A62B 9/04; A62B 18/084; A62B 18/02
USPC ..... 128/205.25, 206.27
See application file for complete search history.

(56) References Cited

U.S. PATENT DOCUMENTS 3,011,525 A * 12/1961 Randle ..... B29D 23/001 138/126
3,148,898 A * 9/1964 Somers ..... F16L 33/01 285/222.1
4,437,462 A 3/1984 Piljay et al.
4,751,869 A * 6/1988 Paynter ..... B29C 70/222 92/103 F (Continued)

FOREIGN PATENT DOCUMENTS

WO WO 2007110670 A1 * 10/2007 ..... A62B 18/084
WO WO2012/017265 2/2012

OTHER PUBLICATIONS

International Preliminary Report on Patentability for International Application No. PCT/US2016/038576, dated Jan. 2, 2018, 11 pages.

(Continued)

*Primary Examiner* — Tan-Uyen T Ho
*Assistant Examiner* — Margaret M Luarca
(74) *Attorney, Agent, or Firm* — Donna P. Suchy

(57) ABSTRACT

An aircraft inflatable harness assembly for an aircraft oxygen crew mask for providing regulated flow of oxygen on board an aircraft for an aircraft crew. The aircraft inflatable harness includes at least one inner inflatable tube having a normally deflated configuration and an inflated configuration. The inner inflatable tube has a first and second end, and is configured to inflate to cause expansion of the harness assembly to allow the harness assembly to be placed over a user's head. The inner inflatable tube includes a braided outer sleeve of elastic material. The outer sleeve is configured to have a first length when the inner inflatable tube is in a normally deflated configuration, and the outer sleeve is configured to longitudinally expand to a second length greater than the first length while remaining appreciably the same diameter in the radial direction when the inner inflatable tube is in an inflated configuration.

14 Claims, 2 Drawing Sheets

(56) References Cited

U.S. PATENT DOCUMENTS

| | | | | |
|---|---|---|---|---|
| 4,898,212 | A * | 2/1990 | Searfoss | F16L 11/088 138/124 |
| 4,915,106 | A | 4/1990 | Aulgur et al. | |
| 2003/0000530 | A1* | 1/2003 | McDonald | A62B 7/14 128/205.25 |
| 2011/0011405 | A1* | 1/2011 | Dussart | A62B 18/084 128/207.11 |
| 2011/0077498 | A1* | 3/2011 | McDaniel | A61B 18/1492 600/374 |
| 2012/0325360 | A1* | 12/2012 | McGrath | F16L 11/02 138/109 |
| 2017/0056065 | A1* | 3/2017 | Do | A61B 17/3423 |

OTHER PUBLICATIONS

International Search Report, PCT/US2016/038576, dated Sep. 15, 2016, 4 pages.

* cited by examiner

HARNESS ASSEMBLY FOR AIRCRAFT PILOT CREW MASK

BACKGROUND

This invention relates to crew masks to be used in large aircraft for crew safety and in the event of decompression of the cabin. More particularly, the invention relates to the inflatable harness used to secure such a mask in place for use.

A commonly used type of crew mask includes an inflatable head harness with inflatable elastic tubes that are inflated prior to placement of the harness over the head of the user, and that are then deflated to grip the user's head. A valve is connected to the tubes to control inflation by pressurized gas, such as from an oxygen supply of a regulator on the respiratory mask, and deflation.

Another similar type of oxygen supply system includes an oxygen supply with a face mask and an inflatable head harness. A plurality of chemical oxygen generators provide oxygen to a reservoir, to initially inflate the pneumatic head harness and provide an initial breathing supply during the startup of the chemical oxygen generators.

The prior art uses a harness, with an inflatable silicone inner tube, along with a regulator to provide oxygen for pilots. The inflation feature of the harness allows pilots to don the crew mask in a quick manner.

In a typical conventional crew mask, illustrated in FIG. 1, an inflatable crew mask assembly includes an inflatable harness 10 connected to an oronasal face seal molding or mask portion 12 formed to fit to a face of a wearer when the inflatable harness is fitted over the wearer's head and properly inflated. A lower forward portion of the mask portion includes a smoke goggle purge flow actuation lever 14, a harness inflation control button 16, a connector 18 between the inflatable harness and an oxygen supply regulator assembly 20, and a control knob 22. The regulator typically supplies breathing oxygen to the mask wearer through ports internal to the lower forward portion of the face seal, and also supplies oxygen or other breathing gas mixtures to the inflatable harness via an oxygen pressure supply hose 24, including a pressure indicator 26, coupling 28, and microphone connection cable 30. The inflatable harness typically includes a rear inflatable tube 32 or strap connected via connectors 34 to a lower inflatable tube 36 connected to the oxygen supply regulator assembly. The inflatable harness may also be adjustable for the size and comfort of the mask once inflated. Upon depression of the harness inflation button the oxygen from its source flows into the harness assembly.

The prior art relied on a silicone inner tube that inflated by pressurized oxygen and was constrained to not burst by a porous over-braid. Specifically, the prior art inflatable harness typically consists of an inflatable silicone tube treated with talc or talcum powder and covered with a braided sleeve of Nomex® braided material. The braiding helps the tube withstand higher pressures, and depending on the ratio of length of the Nomex® braided sleeve to tube length, the length of expansion can be controlled in the longitudinal direction while the diameter of the Nomex® braided sleeve controls tube expansion in the radial direction. The nominal operating pressure is 70 to 85 psig.

As seen in FIG. 1, there are several sections within the harness assembly with varying length of tubing and associated joints where these sections meet and are held in place with various means. The ends of the Nomex® covered silicone tubes are connected to the mask by means of crimped ferrules. Accessories, such as a back pad and head straps are attached to the Nomex® covered silicone tubes to create the harness shape. The ends of the braid are also taped during assembly of the harness to prevent the ends from unraveling.

During cycling of the harness assembly, the silicone tubes inflate as oxygen from the crew mask is supplied to the harness assembly, creating an increase in pressure. As noted above, the tubing increases in length in the longitudinal direction, while the radial increase in tube diameter is controlled by the Nomex® sleeve.

However, the silicone inner tube is highly susceptible to puncture and abrasion. One of the main observed failure modes of the prior art is leakage within the harness due to tears in the tube caused by stress and fatigue after repeated inflation cycles. Deformation of the tubing when a harness assembly is subjected to repeated inflation cycles causes the formation of small holes in the tubing that can consequently result in significant leakage from the tubing.

Moreover, the prior art fails to provide a robust assembly in controlling the radial diameter of the silicone tube by the Nomex® sleeve. Pleating of the Nomex® braid in manufacturing is both difficult and inconsistent. Once the harness assembly is inflated several times, the Nomex® braid pleats will form an irregular pattern along the length of the tube. This irregularity in pleat spacing creates a non-uniform radial increase in the tube diameter. This non-uniform radial increase in diameter creates areas in the tube length where the diameter will balloon. In these areas, the outer surface of the tube is eroded away, causing a decrease in tube wall thickness and eventual tube failure.

In addition, once a prior art harness has been cycled for approximately 20,000 cycles, the silicone tubing takes a set in the longitudinal direction. This set increases the length of the harness in the non-inflated condition, which has a detrimental effect on the harness tension and ultimately the ability of the crew mask to provide an adequate face seal.

It therefore would be desirable to provide an inflatable harness crew mask with an inflatable harness that is able to inflate and expand over a user's head without requiring the silicone tube to be treated with talc or talcum powder, the braid to be pleated, nor the ends of the braid to be taped during assembly of the harness. It would also be desirable to provide an inflatable harness crew mask with an inflatable harness having a braid material that is allowed to stretch in the longitudinal direction without an appreciable change in axial diameter. It would further be desirable to provide an inflatable harness crew mask with an inflatable harness having a braid whose diameter remains relatively constant over the stretched length such that the braid provides a consistent, controlled and limited expansion of the silicone tube in the radial direction. It also would be desirable to provide an inflatable harness crew mask whose number of harness cycles can be increased by 50 fold compared to the prior art, and can be inflatable from at least 18,250 times to up to 40,000 times without failure. It would be further desirable to provide an inflatable harness crew mask which has no appreciable change in harness tension measured before cycling compared to that measured after cycling. It would also be desirable to provide an inflatable harness crew mask which has significantly higher reliability than the prior art to withstand inflation related wear and tear over the lifetime of the crew mask without adding weight to the existing design. The present invention meets these and other needs.

SUMMARY OF THE INVENTION

The improved crew mask harness according to the present invention provides one or more benefits and advantages not previously offered by the prior art, including but not limited to, an aircraft inflatable harness assembly having significantly higher reliability to withstand inflation related wear and tear given the operational pressure range of 50-125 psi and over the lifetime of the crew mask without adding weight to the existing design.

Accordingly, the present invention provides for an aircraft inflatable harness assembly for an aircraft oxygen crew mask for providing regulated flow of oxygen on board an aircraft for an aircraft crew. The aircraft inflatable harness includes at least one inner inflatable tube having a normally deflated configuration and an inflated configuration. The inner inflatable tube has a first end and a second end, and is configured to be inflated to cause expansion of the harness assembly to allow the harness assembly to be placed over a user's head.

The inner inflatable tube includes a braided outer sleeve of polyethylene terephthalate elastic material. The outer sleeve of elastic material is configured to have a first length when the inner inflatable tube is in a normally deflated configuration, and the outer sleeve of elastic material is configured to longitudinally expand to a second length greater than the first length when the inner inflatable tube is in an inflated configuration. Inflation of the at least one inner inflatable tube causes the outer sleeve of elastic material to expand in a longitudinal direction to the second length, which allows the aircraft inflatable harness assembly to be placed over the user's head. Deflation of the inner inflatable tube causes the outer sleeve of elastic material to retract in a reverse longitudinal direction back to the first length, thus allowing the aircraft inflatable harness assembly to grip the user's head with a desired head tension.

According to a presently preferred aspect, the inner inflatable tube is a silicone tube. In another presently preferred aspect, the inner inflatable tube is a continuous inner inflatable tube. In another presently preferred aspect, the inner inflatable tube has an internal diameter of 0.250 inch to 0.375 inch. In another presently preferred aspect, the inner inflatable tube has a wall thickness of 0.0625 inch to 0.095 inch.

In another presently preferred aspect, there is provided a plurality of inner inflatable tubes. In another presently preferred aspect, a mask attachment fitting having a barbed end is secured to the first end of the inner inflatable tube by a crimped ferrule. The mask attachment fitting is configured to connect to a crew mask for control of inflation and deflation of the inner inflatable tube. In another presently preferred aspect, a mask attachment tube is secured to the second end of said at least one inner inflatable tube by a crimped ferrule. In another presently preferred aspect, an elastic head strap is connected between the plurality of inner inflatable tubes for adjustment of positioning of the harness assembly on the user's head. In another presently preferred aspect, a back pad is connected between the plurality of inner inflatable tubes to form a contour of the harness assembly for positioning of the harness on the user's head.

In another presently preferred aspect, the outer sleeve of elastic material is heat-set. In another presently preferred aspect, the second length of the outer sleeve of elastic material in the inflated configuration is at most twice the first length of the outer sleeve of elastic material in the deflated configuration. In another presently preferred aspect, the second length of the outer sleeve of elastic material in the inflated configuration is up to twice the first length of the outer sleeve of elastic material in the deflated configuration.

In another presently preferred aspect, the inflatable harness assembly is dimensioned such that its performance is easily optimized by adjusting parameters related to oxygen pressure requirements. In another presently preferred aspect, the inflatable harness assembly is designed to withstand all flow requirements to ensure safe and reliable operation.

Other features and advantages of the present invention will become more apparent from the following detailed description of the preferred embodiments in conjunction with the accompanying drawings, which illustrate, by way of example, the operation of the invention.

DETAILED DESCRIPTION OF THE PREFERRED EMBODIMENTS

Figure 1:
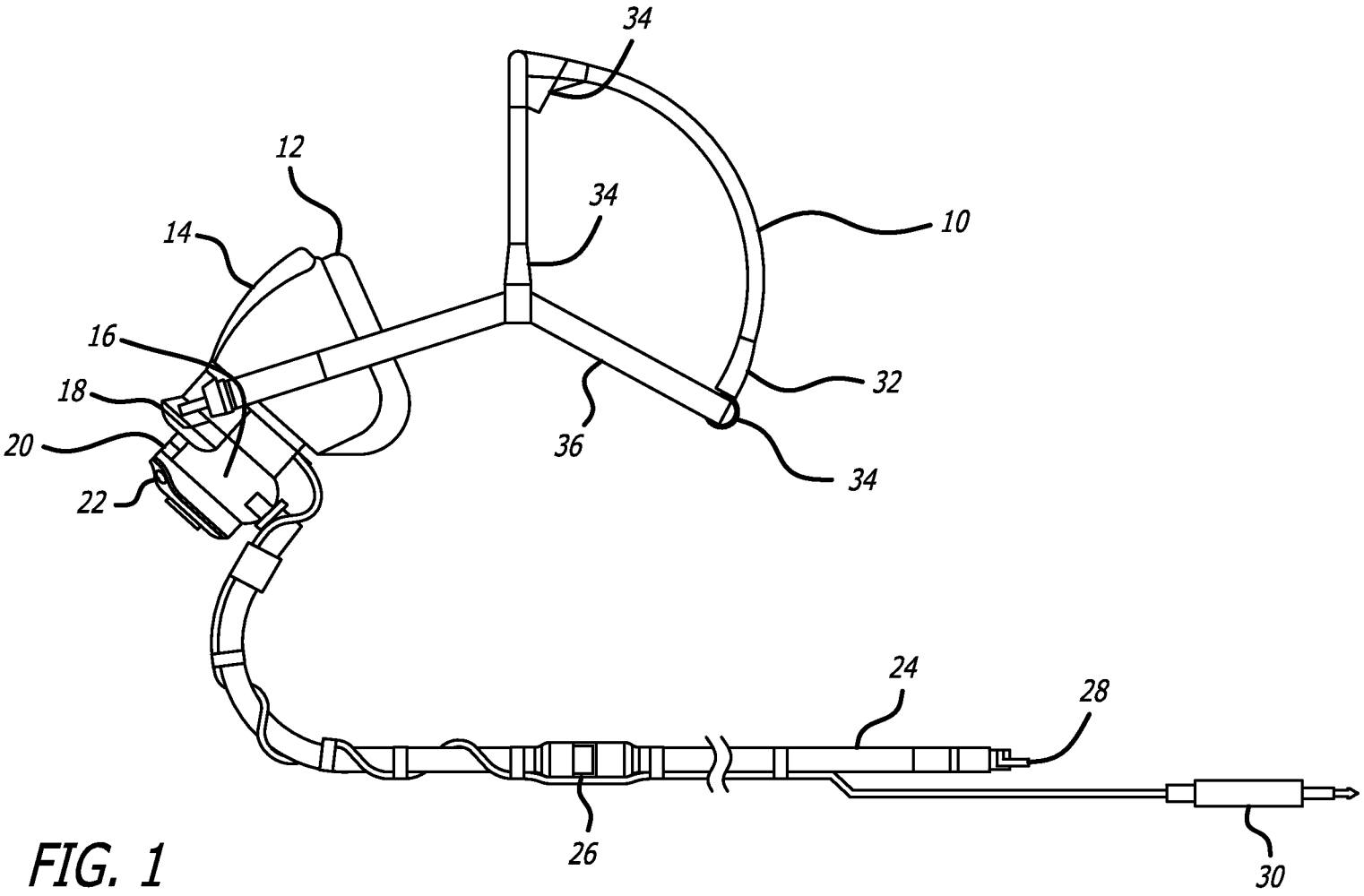
FIG. 1 is a diagram of a prior art crew mask.
Figure 2:
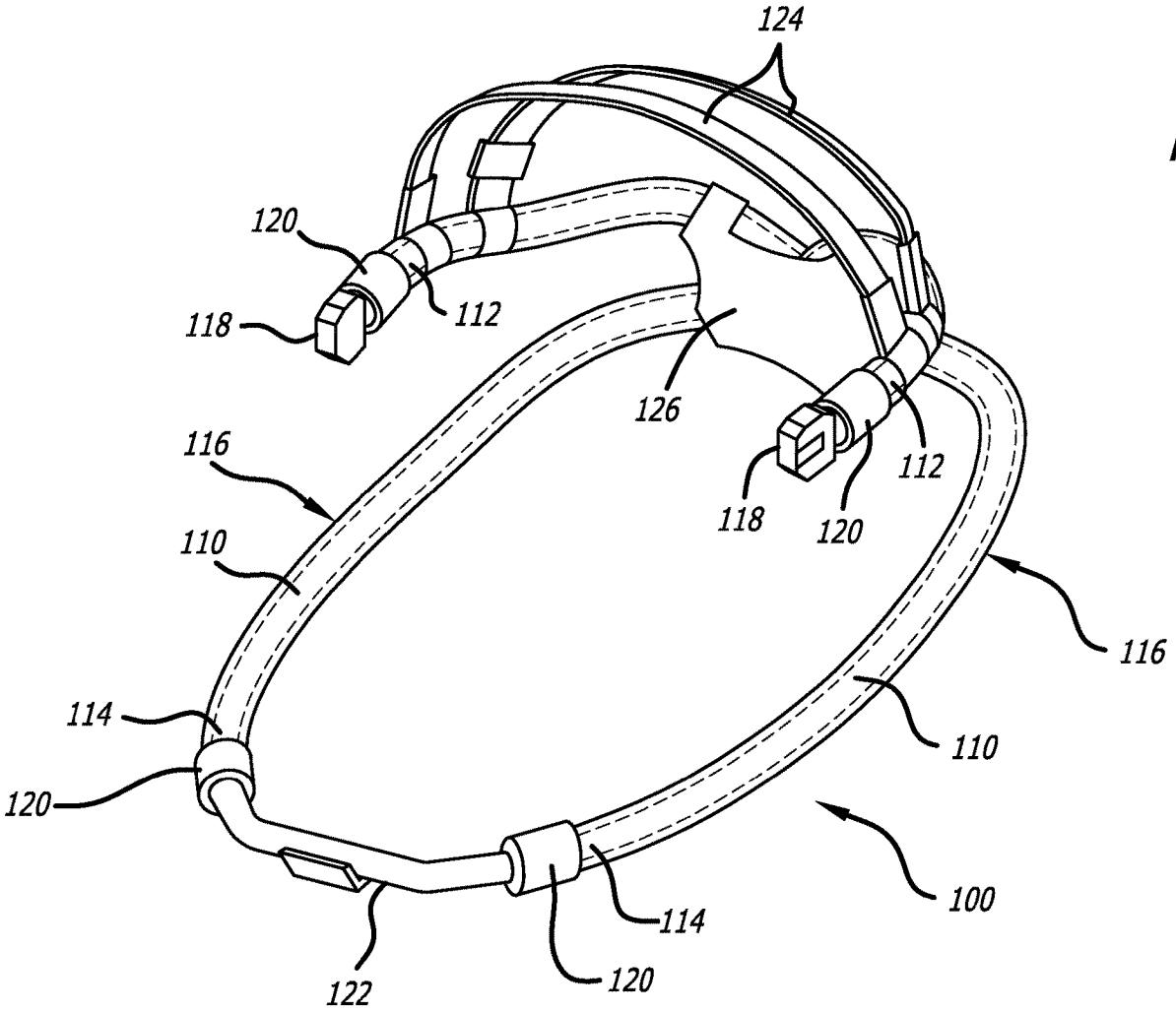
FIG. 2 is a perspective view of the aircraft inflatable harness assembly for an aircraft oxygen crew mask, according to the invention.

FIG. 2 describes a preferred embodiment of the aircraft inflatable harness assembly according to the present invention, in which there is provided an aircraft inflatable harness assembly 100 having inner inflatable tubes 110, typically silicone and preferably continuous, each having a first end 112 and a second end 114.

The inner inflatable tubes have an outer sleeve 116 of elastic material which is preferably made from heat-set, braided, polyethylene terephthalate (PT). Preferably, a braided sleeve available under the brand name CLEAN CUT FR (flame retardant), manufactured by TECHFLEX® with monofilament fibers, is used as the outer sleeve 116 of elastic material. The nature of the PT braided outer sleeve 116 allows it to stretch with the inner inflatable tube 110 in a longitudinal direction without an appreciable change in axial diameter, the diameter of the braid remaining relatively constant over the stretched length. This characteristic of the braid provides a consistent, controlled and limited expansion of the silicone tube in the radial direction. With the consistent control of the tube expansion in the radial direction, the tubing 110 is less prone to wear due to erosion of the tube surface resulting in a change to the tube wall thickness.

The aircraft inflatable harness assembly 100 further includes mask attachment fittings 118, typically having a barbed end, which are inserted into the first end 112 of the inner inflatable tubes 110 and held in place with crimped ferrules 120. A mask attachment tube 122 is inserted into the second end 114 of the inner inflatable tubes 110 and also held in place with crimped ferrules 120. Elastic head straps 124 are connected to the inner inflatable tubes to adjust the positioning of the harness assembly on the user's head. A back pad 126 is connected to the inner inflatable tubes 110 to form a contour of the harness assembly for positioning of the harness on the user's head.

According to a preferred aspect, the length of the PT braided outer sleeve 116 is at least the length of the inner inflatable tube 110 between the transition zones of the harness created by the back pad 126 and the head straps 124, with excess braid compressed along the length of the inner inflatable tube, thus promoting stretch of the braided outer sleeve 116 in the longitudinal direction during inflation. The ratio of sleeve length to tube length can be optimized and is dependent on the braid weave and the braid filament diameter of the braided outer sleeve 116. Preferably, the inner inflatable tube and braided outer sleeve have a longitudinal stretch ratio of approximately 2:1 or less, that is, the length of the PT braid covered inner inflatable tube stretches up to approximately twice its original length. This ratio is set so that the harness can accommodate a wide variety of user head sizes and can vary based on the harness configuration. In a presently preferred aspect, the length of the PT braid covered inner inflatable tube stretches to at most twice its original length. Testing has shown that preferably having a longitudinal stretch ratio of approximately 2:1 or less allows the braided outer sleeve 116 to longitudinally expand in an inflated configuration without an appreciable change in axial diameter, thus providing consistent, controlled and limited expansion of the inner inflated tube in the radial direction.

The following tables illustrate various, non-limiting examples of tested configurations of longitudinal stretch ratios and sleeve-to-tube length ratios using a TECHFLEX® CLEAN CUT FR braided outer sleeve as the outer sleeve 116 of elastic material:

TABLE 1

Longitudinal Stretch Ratios

| Sleeve Length (Unstretched) | Sleeve Length (Stretched) | Longitudinal Stretch Ratio |
|---|---|---|
| 4 inches | 5.5 inches | 1.37 |
| 8.5 inches | 11.5 inches | 1.35 |

TABLE 2

Sample Sleeve-To-Tube Length Ratios (Braid Filament Diameter: 0.085 inches)

| Inflatable Tube Length (Deflated) | Sleeve Length (Deflated) | Tube/Sleeve Travel Distance (Inflated) | Sleeve-To-Tube Length Ratio |
|---|---|---|---|
| 4 inches | 4 inches | 0 inches | 1.00 |
| 4 inches | 5.5 inches | 0.875 inches | 1.375 |
| 4 inches | 6.75 inches | 1.5 inches | 1.68 |
| 4 inches | 8 inches | 1.5 inches | 2.00 |

TABLE 3

Exemplary Sleeve-To-Tube Length Ratios

| Harness | Inflatable Tube Length | Sleeve Length | Sleeve-To-Tube Length Ratio |
|---|---|---|---|
| Example 1 | 7 inches | 12.5 inches | 1.79 |
| Example 2 | 7 inches | 13.75 inches | 1.96 |

The inner inflatable tubes 110 and the PT braided outer sleeve 116 are normally in a deflated configuration. When oxygen or air pressure of 50-125 psi is supplied, inflation of the inner inflatable tube 110 causes the braided outer sleeve to stretch and expand in a longitudinal direction while remaining appreciably the same diameter in the radial direction, allowing the harness assembly to be placed over the user's head. When the harness assembly is deflated, deflation of the inner inflatable tube 110 causes the braided outer sleeve to retract in a reverse longitudinal direction back to its original length, allowing the harness assembly to grip the user's head with a desired head tension.

Testing of the present invention has shown that the number of harness cycles can be increased by 50 fold compared to the prior art using the PT braided outer sleeve, lasting up to 40,000 cycles without failure notwithstanding its lifecycle target of 18,250 cycles. Moreover, unlike the Nomex® braided silicone tubes which take a set in the longitudinal direction after repeated cycles and thus result in decreased harness tension, testing of the present invention has shown that there is no appreciable change in harness tension measured before cycling compared to that measured after cycling. Furthermore, by providing consistent, controlled and limited expansion of the inner inflated tube in the radial direction after repeated inflation cycles, the preferred embodiment addresses the Nomex® sleeve prior art's problem of failing to provide a robust assembly in controlling the radial diameter of the inflatable tubes, thus having significantly higher reliability to withstand inflation related wear and tear over the lifetime of the crew mask without adding weight to the prior art's existing design. Moreover, the improved harness does not require the inner inflatable tubes 110 to be treated with talc or talcum powder, nor does the braided outer sleeve 116 need to be pleated. Also, due to the post heat setting of the PT braid, the ends of the braided outer sleeve do not unravel, thus eliminating the need to tape the ends during assembly of the harness.

What is claimed is:

1. An aircraft inflatable harness assembly for an aircraft oxygen crew mask operating between 50 and 125 psi for providing regulated flow of oxygen on board an aircraft for an aircraft crew, comprising:

at least one inner inflatable tube having a normally deflated configuration and an inflated configuration, said at least one inner inflatable tube having a first end and a second end, said at least one inner inflatable tube being configured to be inflated to cause expansion of the harness assembly to allow the harness assembly to be placed over a user's head, the at least one inner inflatable tube having an internal diameter greater than or equal to 0.250 inches and less than or equal to 0.375 inches and a wall thickness greater than or equal to 0.0625 inches and less than or equal to 0.095 inches, said at least one inner inflatable tube including a braided outer sleeve of elastic material, the outer sleeve made of polyethylene terephthalate, wherein the inner inflatable tube includes a silicone tube;

wherein said outer sleeve of elastic material is configured to have a first length when said at least one inner inflatable tube is in the normally deflated configuration, and wherein said outer sleeve of elastic material is configured to longitudinally expand to a second length greater than the first length when said at least one inner inflatable tube is in the inflated configuration, wherein the first length is greater than or equal to a third length of the at least one inner inflatable tube in the normally deflated configuration, the outer sleeve having a longitudinal stretch ratio of two to one or less;

wherein inflation of said at least one inner inflatable tube causes said outer sleeve of elastic material to expand in a longitudinal direction to the second length to allow the aircraft inflatable harness assembly to be placed over the user's head, and wherein deflation of said at least one inner inflatable tube causes said outer sleeve of elastic material to retract in a reverse longitudinal direction back to the first length to allow the aircraft inflatable harness assembly to grip the user's head with a desired head tension.

2. The aircraft inflatable harness assembly of claim 1, wherein the at least one inner inflatable tube is a continuous inner inflatable tube.

3. The aircraft inflatable harness assembly of claim 1, further comprising at least one mask attachment fitting having a barbed end secured to the first end of said at least one inner inflatable tube, said mask attachment fitting being configured to be connected to a crew mask for control of inflation and deflation of said at least one inner inflatable tube.

4. The aircraft inflatable harness assembly of claim 3, wherein the at least one mask attachment fitting is secured to the first end of the inner inflatable tube by a crimped ferrule.

5. The aircraft inflatable harness assembly of claim 1, further comprising a mask attachment tube secured to the second end of said at least one inner inflatable tube.

6. The aircraft inflatable harness assembly of claim 5, wherein the mask attachment tube is secured to the second end of the inner inflatable tube by a crimped ferrule.

7. The aircraft inflatable harness assembly of claim 1, wherein the at least one inner inflatable tube comprises a plurality of inner inflatable tubes.

8. The aircraft inflatable harness assembly of claim 7, further comprising an elastic head strap for adjustment of positioning of the harness assembly on the user's head.

9. The aircraft inflatable harness assembly of claim 7, further comprising a back pad connected between said plurality of inner inflatable tubes to form a contour of the harness assembly for positioning of the harness assembly on the user's head.

10. The aircraft inflatable harness assembly of claim 1, wherein the second length of the outer sleeve of elastic material in the inflated configuration is at most twice the first length of the outer sleeve of elastic material in the deflated configuration.

11. The aircraft inflatable harness assembly of claim 1, wherein the outer sleeve has the longitudinal stretch ratio of two to one or less when between 50 psi and 125 psi of air pressure is applied to the outer sleeve.

12. An aircraft inflatable harness assembly for an aircraft oxygen crew mask operating between 50 and 125 psi for providing regulated flow of oxygen on board an aircraft for an aircraft crew, comprising:

a plurality of inner inflatable tubes having a normally deflated configuration and an inflated configuration, said plurality of inner inflatable tubes each having a first end and a second end, said plurality of inner inflatable tubes being configured to be inflated to cause expansion of the harness assembly to allow the harness assembly to be placed over a user's head, at least one of the inner inflatable tubes having an internal diameter greater than or equal to 0.250 inches and less than or equal to 0.375 inches and a wall thickness greater than or equal to 0.0625 inches and less than or equal to 0.095 inches, said plurality of inner inflatable tubes including a braided outer sleeve of elastic material, the outer sleeve made of polyethylene terephthalate, wherein each of the plurality of inner inflatable tubes includes a silicone tube;

at least one mask attachment fitting having a barbed end secured to the first ends of said plurality of inner inflatable tubes, said mask attachment fitting being configured to be connected to a crew mask for control of inflation and deflation of said plurality of inner inflatable tubes; a mask attachment tube secured to the second ends of said plurality of inner inflatable tubes; an elastic head strap for adjustment of positioning of the harness assembly on the user's head;

a back pad connected between said plurality of inner inflatable tubes to form a contour of the harness assembly for positioning of the harness assembly on the user's head;

wherein said outer sleeve of elastic material is configured to have a first length when said plurality of inner inflatable tubes is in the normally deflated configuration, wherein said outer sleeve of elastic material is configured to longitudinally expand to a second length greater than the first length when said plurality of inner inflatable tubes is in the inflated configuration, wherein the first length is greater than or equal to a third length of each of the plurality of inner inflatable tubes in the normally deflated configuration, the outer sleeve having a longitudinal stretch ratio of two to one or less;

wherein inflation of said plurality of inner inflatable tubes causes said outer sleeve of elastic material to expand in a longitudinal direction to the second length to allow the aircraft inflatable harness assembly to be placed over the user's head; and wherein deflation of said plurality of inner inflatable tubes causes said outer sleeve of elastic material to retract in a reverse longitudinal direction back to the first length to allow the aircraft inflatable harness assembly to grip the user's head with a desired head tension.

13. The aircraft inflatable harness assembly of claim 12, wherein the plurality of inner inflatable tubes are continuous inner inflatable tubes.

14. The aircraft inflatable harness assembly of claim 12, wherein the second length of the outer sleeve of elastic material in the inflated configuration is at most twice the first length of the outer sleeve of elastic material in the deflated configuration.

* * * * *